US008555841B2

(12) United States Patent
Zhu

(10) Patent No.: US 8,555,841 B2
(45) Date of Patent: Oct. 15, 2013

(54) COUPLING PLATE BETWEEN VALVES

(75) Inventor: Lu Zhu, Troy, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/227,762

(22) Filed: Sep. 8, 2011

(65) Prior Publication Data

US 2012/0060955 A1 Mar. 15, 2012

Related U.S. Application Data

(66) Substitute for application No. 61/382,561, filed on Sep. 14, 2010.

(51) Int. Cl.
*F01L 1/18* (2006.01)

(52) U.S. Cl.
USPC ..... 123/90.4; 123/90.22

(58) Field of Classification Search
USPC ..... 123/90.22, 90.23, 320, 321, 90.39, 123/90.4, 90.41; 74/569
See application file for complete search history.

(56) References Cited

U.S. PATENT DOCUMENTS

2009/0139477 A1* 6/2009 Wotherspoon et al. .... 123/90.22

* cited by examiner

*Primary Examiner* — Thomas E. Denion
*Assistant Examiner* — Daniel Bernstein
(74) *Attorney, Agent, or Firm* — Lucas & Mercanti, LLP

(57) ABSTRACT

A coupler plate for a multi-valve system of an internal combustion engine. The coupler plate includes an elongated planar body and through holes on opposite ends. The through holes may be either closed or open ended, and of sufficient size to insert valve stems of valves for an internal combustion engine valve system.

8 Claims, 5 Drawing Sheets

COUPLING PLATE BETWEEN VALVES

FIELD OF THE INVENTION

Example aspects herein relate to valve systems for internal combustion engines, and more particularly to a coupling plate for valves where at least one valve bridge is used to transmit camshaft motion in a valve system to at least two valves with at least one lever.

BACKGROUND OF THE INVENTION

Valve actuation in an internal combustion engine can take many forms. Generally, during combustion, intake valves may be opened to admit air into a cylinder to combine with fuel for combustion. One or more exhaust valves may be opened to allow exhaust gases, resulting from combustion, to escape from the cylinder. Intake, exhaust or auxiliary valves may be opened at various times to recirculate gases for improved fuel economy and emissions.

It is known in the art to utilize a chain or belt between a sprocket or pulley on an engine crankshaft and a sprocket or pulley on a camshaft sprocket to turn at least one associated camshaft. A camshaft generally has several lobes along its length, the lobes designed such that each revolution of the camshaft causes a lobe to come in contact a valve actuation element. This element can take many forms known in the art, including a rocker arm or roller finger follower, for example. This valve actuation element converts the rotational motion of the camshaft into linear movement of the valves.

it is further known in the art to utilize more than one valve per intake or exhaust of each cylinder. Such multi-valve operation improves air flow of intake and exhaust gases, potentially improving combustion efficiency, power and performance. Where two or more valves are used in an intake or exhaust valve arrangement, it is known to utilize a valve bridge to activate two valves by one lever or valve actuation element. The force from the cam lobe is transferred through the valve actuation element and onto a contacting pad located equidistantly from the motion plane of each valve in contact with the particular valve bridge. This enables the theoretical value of the moment arm to the two contact areas of the two or more valve stem tips to the valve bridge contact pad to be equal, therefore generating an identical valve motion and valve stem tip contact force. This contacting pad may he integral to the valve bridge or may be formed as a separate button.

However, in actual operation, the valve bridge may apply force to the valve stems unevenly or the valves may be actuated out of unison. This imbalanced movement of the valve bridge can be caused by many factors, for example, the geometric and assembling tolerances of the various components of the system may cause the contact positions of the valve stem and valve bridge to deviate from their intended positions. In addition, the valve spring preload and spring rates may vary by 10% or more, introducing uneven movement of the two valves.

This uneven movement or actuation of the valves often is undesirable because it can contribute to reduced life from increased and more varied valve seating velocity. In extreme cases, the valve stem may break due to edge loading at the valve stem tip owing to substantially uneven loading.

SUMMARY OF THE INVENTION

The present invention relates to a multi-valve system and a coupler plate, which connects to at least two valves in a multi-valve system.

The multi-valve system can comprise at least two valves, valve springs, with at least one valve spring disposed around at least one corresponding valve, at least one retainer element arranged to retain at least one of the valves and springs, and at least one coupler plate, arranged to couple the valves.

At least two holes can be formed in the coupler plate, adjacent opposite ends of the coupler plate. The holes can be closed. Alternatively, at least one of the holes may not be closed.

The coupler plate for a valve system for an internal combustion engine can comprise a rigid planar element with at least two holes formed at opposite ends of the planar element and positioned between the valve spring retaining plate on the valve stem and the valve spring to receive respective valves of the valve system. At least one of the holes can be closed. Alternatively, at least one of the holes may not be closed.

BRIEF DESCRIPTION OF DRAWINGS

The above mentioned and other features and advantages of the embodiments described herein, and the manner of attaining them, will become apparent and be better understood by reference to the following description of at least one example embodiment in conjunction with the accompanying drawings. A brief description of those drawings now follows.

DETAILED DESCRIPTION OF THE INVENTION

Identically labeled elements appearing in different figures refer to the same elements but may not be referenced in the description for all figures. The exemplification set out herein illustrates at least one embodiment, in at least one form, and such exemplification is not to be construed as limiting the scope of the claims in any manner.

Figure 1:
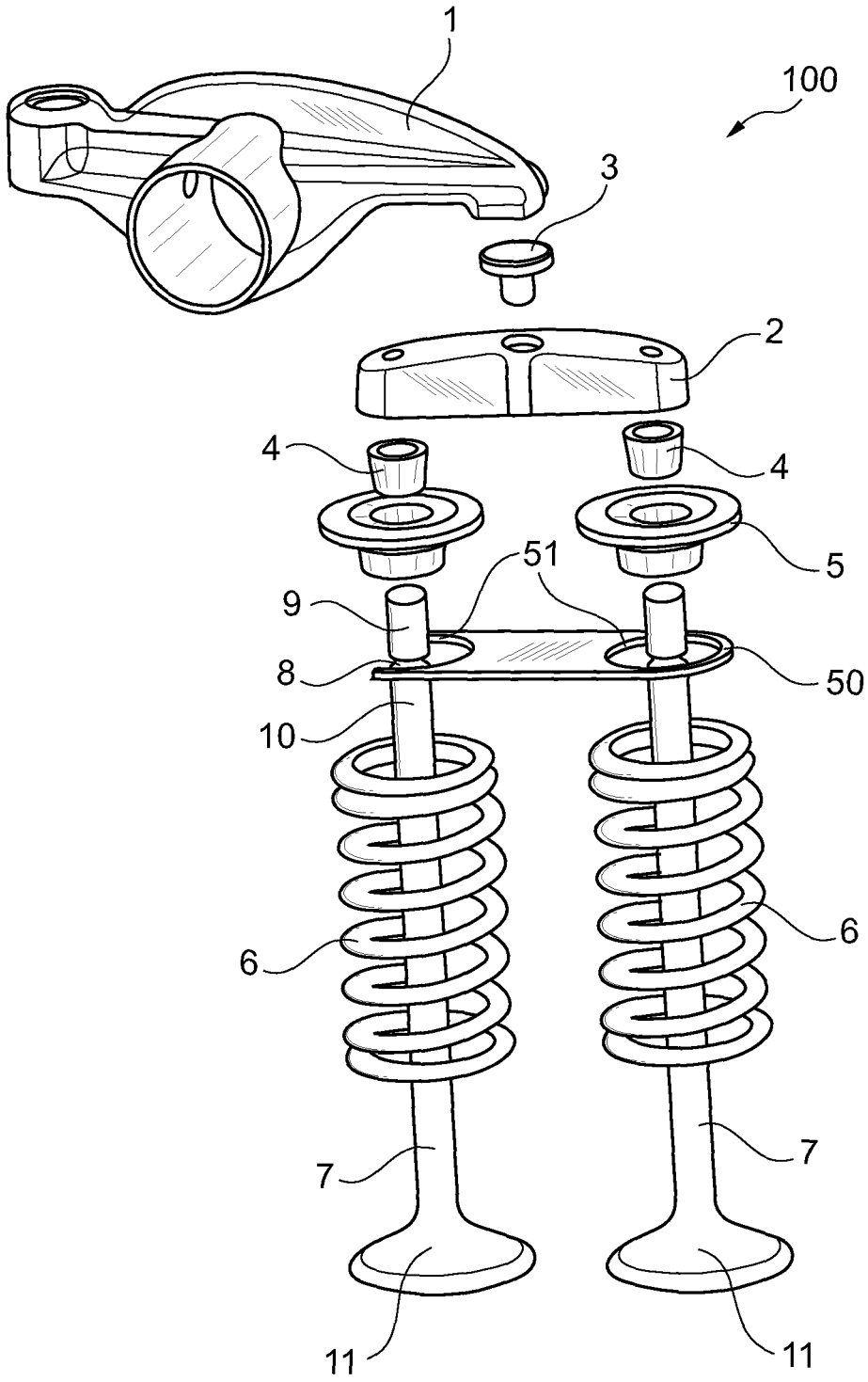
FIG. 1 is an exploded view of a multi-valve system, including a coupler plate, according to an example embodiment herein.

FIG. 1 shows an exploded view of a multi-valve system 100 according to an example embodiment herein. Multi-valve system 100 comprises valve actuation element 1, a valve bridge 2, contact pad 3, valve stem retainers 4, valve spring retainer cups 5, valve springs 6, valves 7, valve tip retention grooves 8, valve tips 9, valve stems 10, valve heads 11 forming other parts of the respective valves 7, and coupler plate 50. In the illustrated embodiment element 1 forms a rocker arm. However any suitable type of valve actuation element is contemplated for use in conjunction with the example embodiments of the present invention. Valve actuation element 1 is arranged so that it can transfer rotational movement of an associated cam lobe (not shown) of a camshaft (not shown) of an internal combustion engine (not shown) into linear movement of at least one of valves 7. Contact pad 3 is shown as a separate element, such as a button or pin-like element, that can be inserted into valve bridge 2. In other example embodiments, however, contact pad 3 can be integrally formed with valve bridge 2 or have a different shape than that depicted. Springs 6 are placed over valves 7, surrounding valve stems 10 of the valves 7. In turn, valve tips 9 are inserted through respective coupler plate holes 51, through spring retainer cups 5 and valve stem retainer cups 4 are assembled around valve tip 9, at a position surrounding valve retention grooves 8. In one example, valve retention cups 4 are cone shaped (or another suitable shape), so that, once assembled, cups 4 and associated valve 7 will not slide through spring retention cups 5 during operation. As described, cups 4 are assembled around and remain at a position surrounding valve retention grooves 8. As springs 6 exert force against spring retention cups 5, spring retention cups 5 are pushed upward toward valve retention cups 4, contacting valve retention cups 4 around a conical surface (or another suitable shape) and thus maintaining a secure position in relation to valve grooves 8.

In this assembly it can be seen that when two valves 7 undergo identical motion, the plate 50 is not deformed and is carried along with valves 7. When one of valves 7 moves in slight variation to the other, coupler plate 50 deforms toward the one of valves 7 with increased displacement. This, in turn generates a reaction load (resulting from the bending and shearing structural stiffness of plate 50) on the other, or lower displacement of valves 7 that tends to reduce displacement variation.

Figure 2:
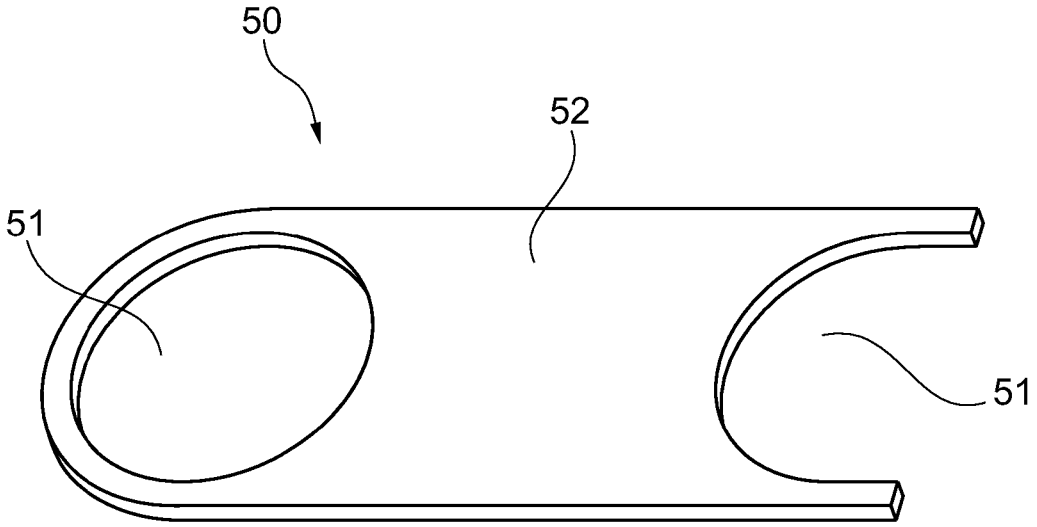
FIG. 2 is an isometric view of the coupler plate of FIG. 1, according to one example embodiment herein.

FIG. 2 shows an isometric view of coupler plate 50 of FIG. 1, according to an example embodiment herein. Coupler plate 50 comprises at least two through holes 51 and planar connecting portion 52, forming a rigid connection between the material surrounding the holes on either end. Although one of holes 51 is shown open on an end, forming a u-shape, in other example embodiments both holes 51 may be closed, or, alternatively, both holes may be open. The use of closed or open holes may depend on ease of assembly and factors specific to a particular application. An open hole on one end, as disclosed herein, may simplify assembly of coupler 50 into a given assembly.

Figure 3:
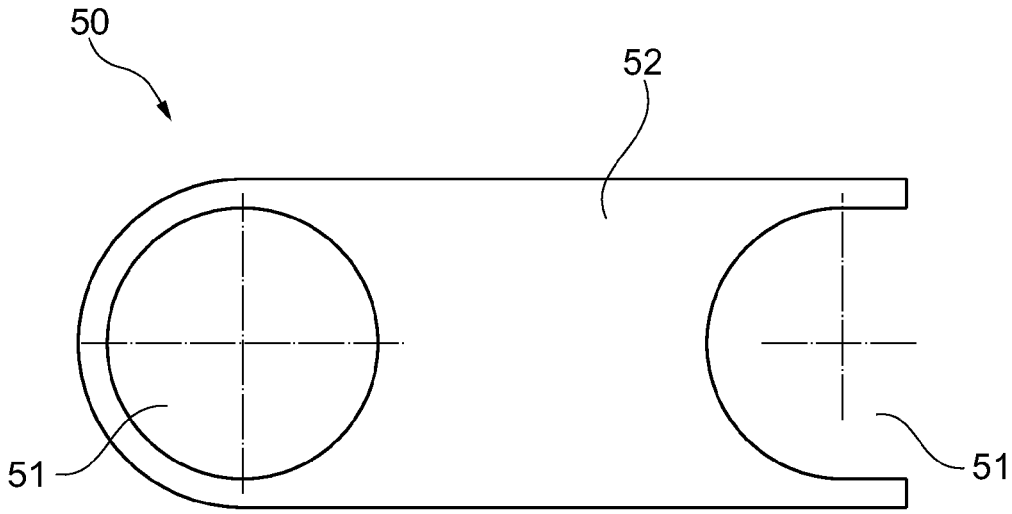
FIG. 3 is a view of the coupler plate of FIG. 2, as viewed from a perspective looking down thereon.

FIG. 3 shows a view of coupler plate 50 of FIG. 2, as viewed from a perspective looking down thereon. The shape and location of holes 51 and planar connecting portion 52 in that perspective are represented.

Figure 4:
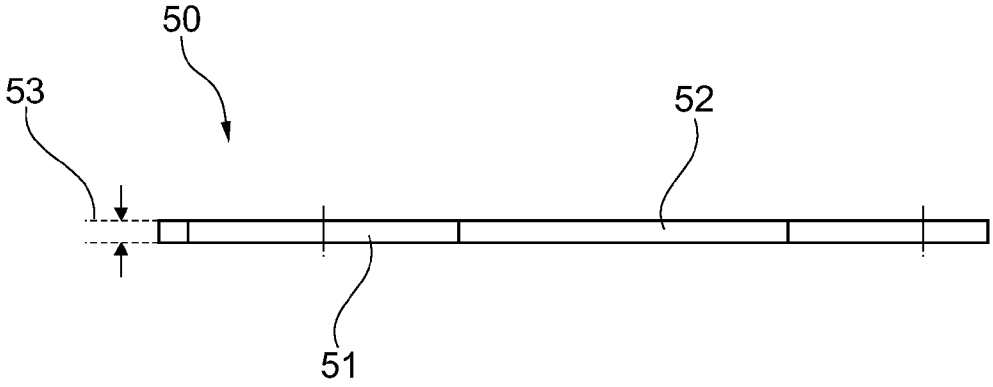
FIG. 4 is a view of the coupler plate of FIG. 2, as viewed from a perspective looking at a side thereof.

FIG. 4 shows a view of coupler plate 50 of FIG. 2, as viewed from a perspective looking at a side thereof. Holes 51 and planar connecting portion 52 are shown. Plate stiffness of plate 50 is determined by, for example, at least the thickness 53, and or shape. Thus, the stiffness can be modified by changing plate thickness 53 or plate shape, or both. Stiffness of plate 50, in one example embodiment is selected based on applicable operating criteria of an application of interest, and preferably such that the independent and free seating of valves 7 is not disturbed.

Figure 5:
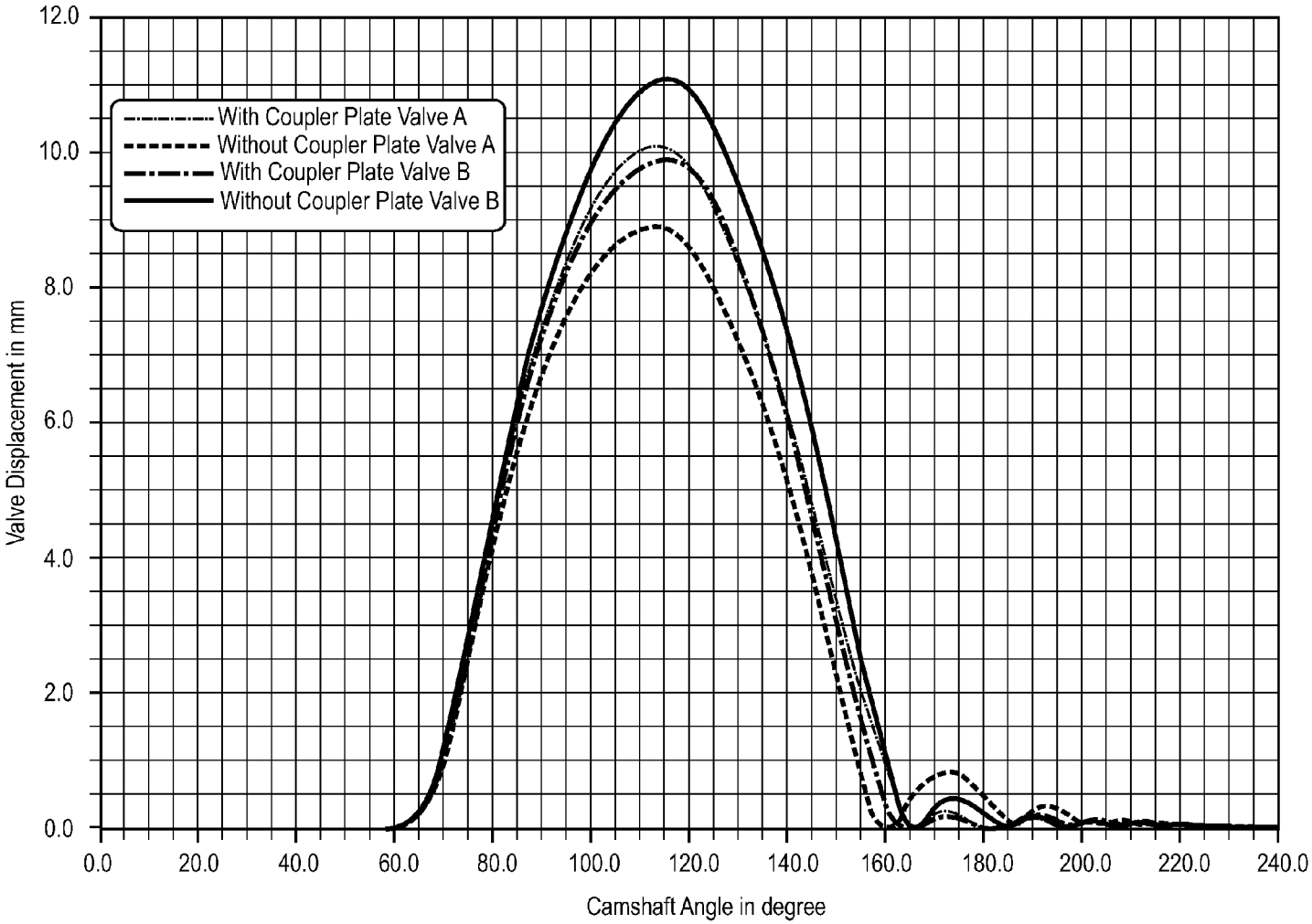
FIG. 5 is a graphical view representing improved valve displacement variation resulting from the coupling plate.

FIG. 5 is a graph representing the manner in which there is improvement in displacement variation of associated valves 7 resulting from use of coupler plate 50, in an example application. As shown, use of coupler plate 50 substantially reduces variation in displacement from a maximum of about 2.0 mm to approximately 0.2 mm.

Figure 6:
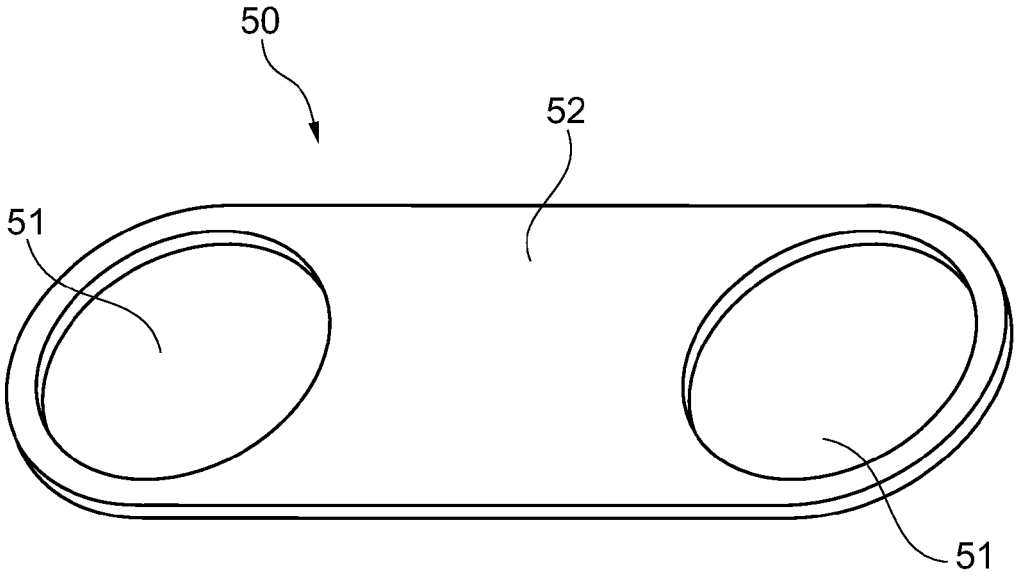
FIG. 6 is an isometric view of a coupler plate with closed ends, according to one example embodiment herein.

FIG. 6 shows an isometric view of an alternative embodiment of coupler plate 50, showing both ends closed.

In the foregoing description, example embodiments are described. The specification and drawings are accordingly to be regarded in an illustrative rather than in a restrictive sense. It will, however, be evident that various modifications and changes may be made thereto, without departing from the broader spirit and scope of the present invention.

In addition, it should be understood that the figures illustrated in the attachments, which highlight the functionality and advantages of the example embodiments, are presented for example purposes only. The architecture or construction of example embodiments described herein is sufficiently flexible and configurable, such that it may be utilized (and navigated) in ways other than that shown in the accompanying figures.

Although example embodiments have been described herein, many additional modifications and variations would be apparent to those skilled in the art. It is therefore to he understood that this invention may be practiced otherwise than as specifically described. Thus, the present example embodiments should be considered in all respects as illustrative and not restrictive.

LIST OF REFERENCE SYMBOLS

1 Valve Actuation Element
2 Valve Bridge
3 Contact Pad
4 Valve Retainer
5 Valve Spring Retainer Cup
6 Valve Spring
7 Valve
8 Valve Retention Groove
9 Valve Tip
10 Valve Stem
11 Valve Head
50 Coupler Plate
51 Coupler Plate Holes
52 Couple Plate Planar Connecting Portion
53 Coupler Plate Thickness
100 Multi-valve System

What is claimed:

1. A mufti-valve system, comprising:

at least two valves;

a valve bridge configured to transmit an actuation force to each of the at least two valves;

valve springs, at least one valve spring disposed around at least one corresponding valve;

at least one retainer element arranged to retain at least one of the valves and springs; and at least one coupler plate, the at least one coupler plate being a planar element arranged to couple the valves independent of the valve bridge, wherein the at least one coupler plate deforms when one of the valves moves in variation to the other and generates a reaction load tending to reduce the variation, the reaction load acting between the at least two valves such that the reaction load does not act on the valve bridge.

2. The multi-valve system of claim 1, wherein at least two holes are formed in the coupler plate, adjacent opposite ends of the coupler plate.

3. The multi-valve system of claim 2, wherein the holes are closed.

4. The multi-valve system of claim 2, wherein at least one of the holes is not closed.

5. The multi-valve system of claim 1, wherein the at least one coupler plate extends between the at least two valves and does not contact the valve bridge.

6. A coupler plate for a valve system for an internal combustion engine, the valve system having at least two valves, a valve bridge configured to transmit an actuation force to each of the at least two valves, valve springs, at least one valve spring disposed around at least one corresponding valve, at least one retainer element arranged to retain at least one of the valves and springs, the coupler plate comprising:

a rigid planar element, at least two holes formed at opposite ends of the planar element to receive valves of the valve system to couple the planar element to each of the valves, wherein the at least one coupler plate deforms when one of the valves moves in variation to the other and generates a reaction load tending to reduce the variation, the reaction load acting between the at least two valves such that the reaction load does not act on the valve bridge.

7. The coupler plate of claim 6, wherein at least one of the holes is closed.

8. The coupler plate of claim 6, wherein at least one of the holes is not closed.

* * * * *